US010287664B2

(12) United States Patent
Kim et al.

(10) Patent No.: US 10,287,664 B2
(45) Date of Patent: May 14, 2019

(54) PRODUCTION METHOD FOR ALLOY 690 ORDERED ALLOY OF IMPROVED THERMAL CONDUCTIVITY, AND ALLOY 690 ORDERED ALLOY PRODUCED THEREBY

(71) Applicant: KOREA ATOMIC ENERGY RESEARCH INSTITUTE, Daejeon (KR)

(72) Inventors: Young-Suk Kim, Daejeon (KR); Sung-Soo Kim, Daejeon (KR); Dae-Whan Kim, Daejeon (KR)

(73) Assignee: KOREA ATOMIC ENERGY RESEARCH INSTITUTE, Daejeon (KR)

( * ) Notice: Subject to any disclaimer, the term of this patent is extended or adjusted under 35 U.S.C. 154(b) by 282 days.

(21) Appl. No.: 14/896,647

(22) PCT Filed: Jun. 5, 2014

(86) PCT No.: PCT/KR2014/004977
§ 371 (c)(1),
(2) Date: Dec. 7, 2015

(87) PCT Pub. No.: WO2014/196814
PCT Pub. Date: Dec. 11, 2014

(65) Prior Publication Data

US 2016/0145730 A1 May 26, 2016

(30) Foreign Application Priority Data

Jun. 7, 2013 (KR) ..... 10-2013-0065539
Jun. 3, 2014 (KR) ..... 10-2014-0067951

(51) Int. Cl.
*C22F 1/10* (2006.01)
*C21D 1/26* (2006.01)
(Continued)

(52) U.S. Cl.
CPC ..... *C22F 1/10* (2013.01); *C21D 1/26* (2013.01); *C21D 1/84* (2013.01); *C22C 19/058* (2013.01)

(58) Field of Classification Search
CPC ..... C22F 1/10
(Continued)

(56) References Cited

U.S. PATENT DOCUMENTS 4,798,633 A 1/1989 Martin et al.
2002/0124915 A1 9/2002 Kobayashi et al.
2006/0266450 A1 11/2006 Kwon et al.

FOREIGN PATENT DOCUMENTS

EP 2275583 A1 1/2011
JP 2009-299120 A 12/2009
(Continued)

OTHER PUBLICATIONS

English language translation of KR1020100104928 to Kim et al. Generated Dec. 6, 2017. (Year: 2017).*
(Continued)

*Primary Examiner* — Brian D Walck
(74) *Attorney, Agent, or Firm* — Knobbe Martens Olson & Bear LLP

(57) ABSTRACT

The present invention relates to ordered Alloy 690 with improved thermal conductivity. By maintaining Alloy 690 in a temperature range of 350-570° C. for a proper amount of time, the atomic arrangement is controlled to properly form the ordered phases. The ordered phases formed in the ordered Alloy 690 increases its thermal conductivity due to a low thermal scattering effect of the ordered phase as observed in pure metals.

13 Claims, 10 Drawing Sheets

(51) Int. Cl.
*C21D 1/84* (2006.01)
*C22C 19/05* (2006.01)

(58) Field of Classification Search
USPC ..... 148/675
See application file for complete search history.

(56) References Cited

FOREIGN PATENT DOCUMENTS

| | | | |
|---|---|---|---|
| JP | 2010-214385 | A | 9/2010 |
| KR | 10-2010-0104928 | A | 9/2010 |
| KR | 10-2011-0105156 | A | 9/2011 |
| WO | 2012/121390 | A1 | 9/2012 |

OTHER PUBLICATIONS

International Search Report dated Sep. 30, 2014 of PCT/KR2014/004977 which is the parent application and its English translation—4 pages.

Kai et al., "The Effects of Heat Treatment on the Chromium Depletion, Precipitate Evolution, and Corrosion Resistance of INCONEL Alloy 690", Metallurgical and Materials Transactions A, Oct. 1989, vol. 20A, pp. 2057-2067.

Samantaroy, "Effect of Heat Treatment on Corrosion Behavior of Alloy 690 and Alloy 693 in Simulated Nuclear High-Level Waste Medium", Corrosion Engineering Section, Apr. 2012, vol. 68, No. 4, pp. 46001-1 to 46001-13.

Extended European Search Report dated Feb. 3, 2017 of the corresponding European Patent Application No. 14807433.9—6 pages.

* cited by examiner

PRODUCTION METHOD FOR ALLOY 690 ORDERED ALLOY OF IMPROVED THERMAL CONDUCTIVITY, AND ALLOY 690 ORDERED ALLOY PRODUCED THEREBY

TECHNICAL FIELD

The present invention relates to a method of manufacturing ordered Alloy 690 to be used in steam generator tubes which function as a heat exchanger in nuclear power plants, and to ordered Alloy 690 manufactured thereby.

BACKGROUND ART

Steam generator tubes of nuclear power plants are a heat exchanger which transfers heat from the primary coolant loop to the secondary one to produce steam in the latter. At an early stage of the nuclear industry, Alloy 600 was mostly used as steam generator tubes but with increasing plant operation time, Alloy 600 is well-known to be very susceptible to primary water stress corrosion cracking (PWSCC). To overcome this problem, Alloy 690 containing a higher content of Cr than Alloy 600 has recently been used as steam generator tubes, instead of Alloy 600, because Alloy 690 is well-known to be much higher resistance to PWSCC.

Alloy 600 is a Ni-base alloy with a composition in weight percent of 14-17% Cr, 6-10% Fe, 0.15% C max., 1% Mn max., 0.5% Si max., and 0.015% S max., and Alloy 690 is a Ni-base alloy with a composition in weight percent of 27-31% Cr, 7-11% Fe, 0.05% C max., 0.5% Mn max., 0.5% Si max., 0.5% Cu max., and 0.015% S max.

As described above, Alloy 690 is a material with a higher Cr concentration than Alloy 600, which was called "Inconel Alloy 690," after the name of the developer, or the Inco Alloys International. Inc. but is now called "Alloy 690" due to the expiration of the patent. Since Alloy 690 has a lower thermal conductivity by 11% than Alloy 600, a replaced steam generator made of Alloy 690 should contain a higher number of Alloy 690 tubes by 11% to compensate the loss of thermal heat transfer caused by a lower thermal conductivity of Alloy 690, leading to an increase in the size of a steam generator tube of Alloy 690 and in the manufacturing cost.

DISCLOSURE

Technical Problem

Based on the experimental observations that pure metals with a high degree of order have very high thermal conductivity whereas alloys with a low degree of order have extremely low thermal conductivity, the present invention is directed to providing a method of overcoming the weakness of Alloy 690 which has high PWSCC resistance but low thermal conductivity. In other words, by increasing the degree of order of Alloy 690 through an ordering treatment, the present invention is directed to providing ordered Alloy 690 with a higher thermal conductivity by 8% or more as compared to Alloy 690 before the ordering treatment.

Technical Solution

To achieve the above-mentioned target, the present invention provides a method of manufacturing ordered Alloy 690 with improved thermal conductivity, the method including solution-annealing Alloy 690; thermally treating the solution-annealed Alloy 690 to manufacture Alloy 690 TT; and ordering the Alloy 690 TT by annealing in a temperature range of 350-570° C. to make ordered Alloy 690.

In addition, the present invention provides a method of manufacturing ordered Alloy 690 with improved thermal conductivity, the method including solution-annealing Alloy 690; thermally treating the solution-annealed Alloy 690 to manufacture Alloy 690 TT; and ordering the Alloy 690 TT by annealing in a temperature range of 350-570° C. to make ordered Alloy 690 before cooling the Alloy 690 TT to room temperature.

In addition, the present invention provides a method of manufacturing ordered Alloy 690 with improved thermal conductivity, including the method where Alloy 690 TT is given the ordering treatment in a temperature range of 350-570° C. to make ordered Alloy 690.

In addition, the present invention provides ordered Alloy 690 with improved thermal conductivity manufactured by the above-mentioned manufacturing method.

Advantageous Effects

According to the present invention, by solution-annealing and thermally treating Alloy 690 to manufacture Alloy 690 TT and ordering the Alloy 690 TT by annealing in a temperature range of 350-570° C., ordered Alloy 690 with a thermal conductivity increase rate of 8% or more as compared to before the ordering treatment can be manufactured.

In addition, according to the present invention, by solution-annealing and thermally treating Alloy 690 to manufacture Alloy 690 TT and ordering the Alloy 690 TT by annealing in a temperature range of 350-570° C., ordered Alloy 690 with not only improved thermal conductivity but also excellent yield and tensile strengths and stress corrosion cracking resistance, can be manufactured.

Furthermore, according to the present invention, since ordered Alloy 690 with a higher thermal conductivity by 8% or more leads to an increase in the heat transfer efficiency by 8% or more when used as steam generator tube, the thermal efficiency of a nuclear power plant increases by 8% or more, or a number of steam generator tubes decreases by 8% or more, thus reducing the size of a steam generator.

EMBODIMENTS

Embodiments of a method of manufacturing ordered Alloy 690 with improved thermal conductivity according to the present invention will be described in more detail below with reference to the attached drawings.

Figure 1:
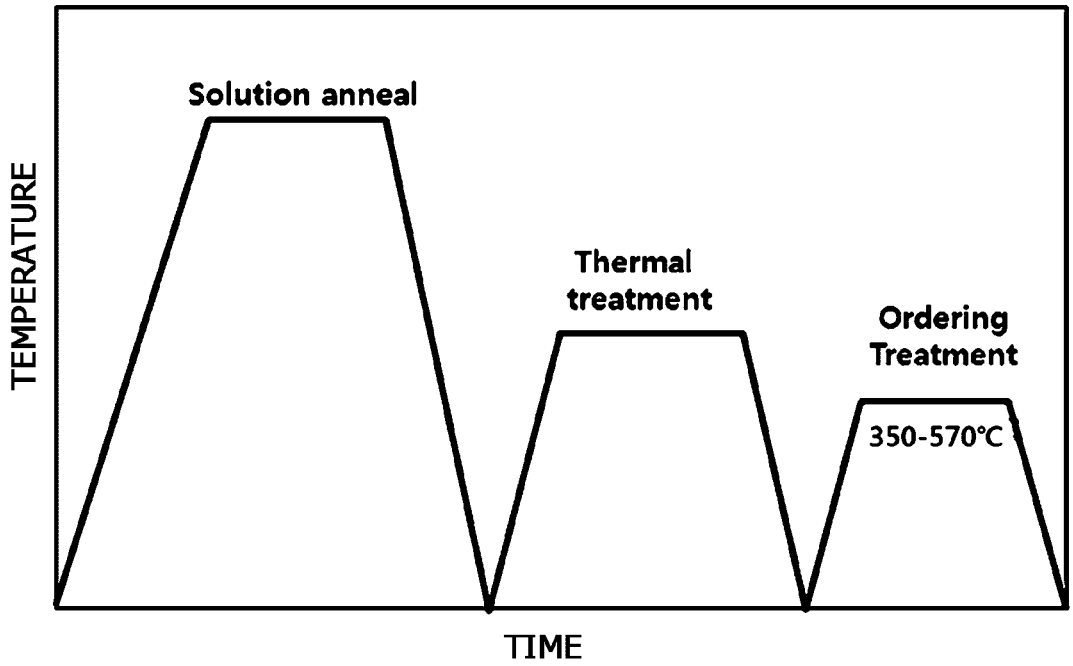
FIG. 1 is a drawing of a process of manufacturing ordered Alloy 690 with improved thermal conductivity according to a first embodiment of the present invention.

FIG. 1 is a drawing of a process of manufacturing ordered Alloy 690 with improved thermal conductivity according to a first embodiment of the present invention. As shown in FIG. 1, ordered Alloy 690 according to the present invention is manufactured by thermally treating conventional Alloy 690 to manufacture Alloy 690 TT and applying an ordering treatment to the Alloy 690 TT. In other words, the ordered Alloy 690 according to the present invention uses a process which applies 1) solution annealing, 2) cooling to room temperature, 3) thermal treatment, 4) cooling to room temperature, and 5) ordering treatment.

First, Alloy 690 TT according to the present invention is manufactured through solution annealing (SA), rapid quenching (or water quenching) to prevent carbides from precipitating within grains, and heating again for a thermal treatment (TT, for 15-24 hours in a temperature range of 700-750° C.) to form carbides primarily at the grain boundary.

According to the present invention, Alloy 690 TT with grain boundary carbides obtained by the thermal treatment has a stabilized atomic arrangement, decreasing the degree of lattice contraction occurring during use in reactors and thereby increasing PWSCC resistance. In other words, when the atomic arrangements of Alloy 690 is stabilized by the thermal treatment, the lattice contraction of Alloy 690 due to ordering hardly occurs during its use in reactors, thus increasing resistance to PWSCC.

Then, Alloy 690 TT according to the present invention is ordered by annealing in a temperature range of 350-570° C. In this process, the ordering treatment process may be performed once or more times. Meanwhile, the "ordered Alloy 690" termed in the present invention designates a new alloy which is obtained by performing an ordering treatment on Alloy 690 TT according to the present invention.

Figure 2:
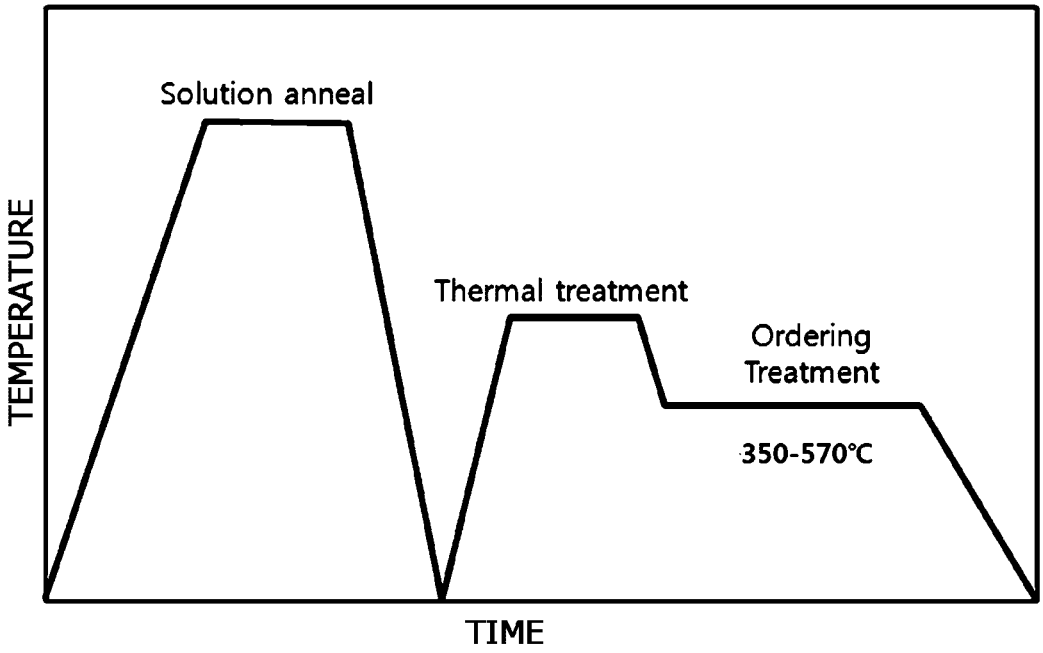
FIG. 2 is a drawing of a process of manufacturing ordered Alloy 690 with improved thermal conductivity according to a second embodiment of the present invention.

FIG. 2 is a drawing of a process of manufacturing ordered Alloy 690 with improved thermal conductivity according to a second embodiment of the present invention. As illustrated in FIG. 2, the second embodiment of the present invention includes 1) solution annealing, 2) cooling to room temperature, 3) thermal treatment, and 4) the ordering treatment before cooling to room temperature. If Alloy 690 TT is given the ordering treatment on the way to cooling to room temperature, the time and energy required for cooling to RT and heating to the ordering treatment temperature can be saved, Thus, the ordering treatment on the way to cooling to room temperature has an advantage in terms of manufacturing.

Figure 3:
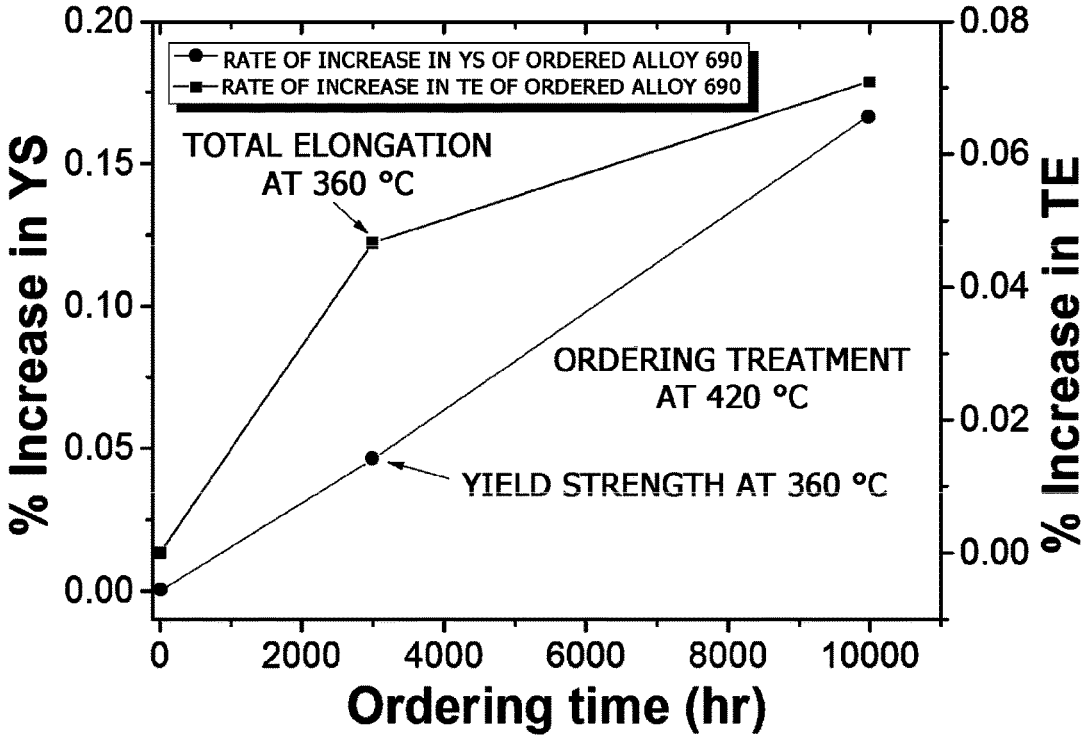
FIG. 3 is a graph illustrating changes in yield strength and total elongation at 360° C. of ordered Alloy 690 which was given the ordering treatment at 420° C. according to an embodiment of the present invention.

FIG. 3 is a graph illustrating changes in yield strength and total elongation at 360° C. of ordered Alloy 690 which was given the ordering treatment at 420° C. according to an embodiment of the present invention. Specifically, FIG. 3 shows tensile properties at 360° C. of ordered Alloy 690 TT with ordering time at 420° C., i.e., 3000 hours and 10,000 hours, respectively. As shown in FIG. 3, when compared to Alloy 690 TT before the ordering treatment, ordered Alloy 690 according to the present invention has higher yield strength (YS) and total elongation (TE). In addition, YS and TE of ordered Alloy 690 almost linearly increase proportionally with increasing ordering time. These observations are at variance with high temperature tensile properties of metals leading to lower strengths and higher ductility, which are obtained by a normal heat treatment at high temperatures, demonstrating that ordered Alloy 690 according to the present invention has completely different material properties from Alloy 690 TT.

Figure 4:
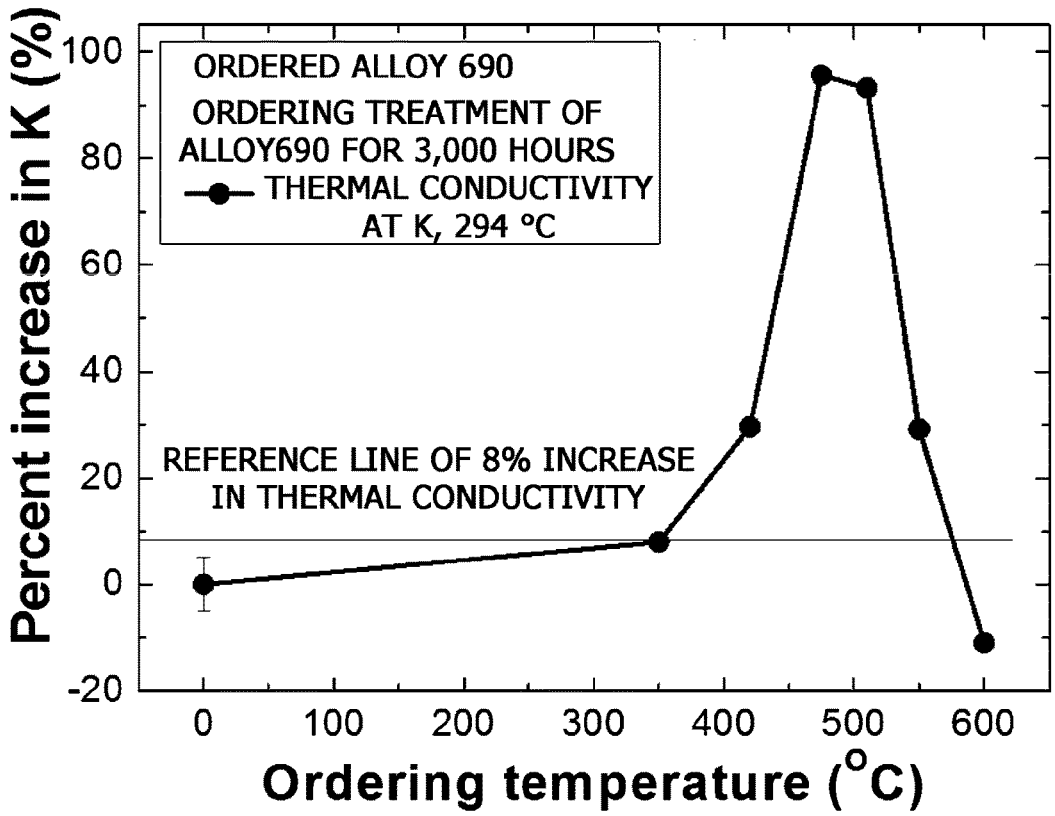
FIG. 4 is a graph illustrating a thermal conductivity increase rate of ordered Alloy 690 at 294° C. with ordering treatment temperature as compared to before the ordering treatment when Alloy 690 is given the ordering treatment in a temperature range of 350-600° C. for 3,000 hours.

FIG. 4 is a graph illustrating a thermal conductivity increase rate of ordered Alloy 690 at 294° C. with ordering treatment temperature as compared to before the ordering treatment when Alloy 690 is given the ordering treatment in a temperature range of 350-600° C. for 3,000 hours. Specifically, FIG. 4 shows the thermal conductivity measured at 294° C. of ordered Alloy 690 by isochronal annealing at temperatures of 350° C., 420° C., 475° C., 510° C., 550° C., and 600° C., respectively, in terms of relative increase rate of thermal conductivity of ordered Alloy 690 TT over Alloy 690 TT. The results of FIG. 4 correspond to the measured thermal conductivity at 294° C., which is close to operating temperatures of nuclear reactors.

As shown in FIG. 4, the thermal conductivity is improved by 8% or more when Alloy 690 is given the ordering treatment at a temperature of 350-570° C. Conventional Alloy 690 with high PWSCC resistance had the weakness of low thermal conductivity. In contrast, ordered Alloy 690 with a high thermal conductivity by 8% or more leads to an increase in the heat transfer efficiency by 8% or more when used as steam generator tubes, and consequently to an increase in the thermal efficiency of a nuclear power plant by 8% or more, or to a number of steam generator tubes decreases by 8% or more, thus reducing the size of the steam generator.

In addition, for the effectiveness of the invention and the relevant properties of Alloy 690, it is preferable that the ordering treatment is performed in a temperature range of 400-510° C., and, furthermore, in a temperature range of 420-510° C. in view of the critical significance.

TABLE 1

| | | | Reaction rate ratio for each reference temperature | | | |
|---|---|---|---|---|---|---|
| Temperature [° C.] | Absolute temperature [K] | Rate | 300° C. | 330° C. | 350° C. | Ordering treatment time for an 8% improvement in thermal conductivity |
| 300 | 573 | 1.305E−23 | 1.0 | | | |
| 310 | 583 | 3.222E−23 | 2.5 | | | |
| 320 | 593 | 7.717E−23 | 5.9 | | | |
| 330 | 603 | 1.795E−22 | 13.8 | 1.0 | | |
| 340 | 613 | 4.063E−22 | 31.1 | 2.3 | | |
| 350 | 623 | 8.959E−22 | 68.6 | 5.0 | 1.0 | 3000 |

TABLE 1-continued

| Temperature [° C.] | Absolute temperature [K] | Rate | Reaction rate ratio for each reference temperature 300° C. | 330° C. | 350° C. | Ordering treatment time for an 8% improvement in thermal conductivity |
|---|---|---|---|---|---|---|
| 360 | 633 | 1.926E−21 | 147.6 | 10.7 | 2.2 | 1363 |
| 370 | 643 | 4.045E−21 | 310.0 | 22.5 | 4.5 | 666 |
| 380 | 653 | 8.303E−21 | 636.2 | 46.2 | 9.3 | 322 |
| 390 | 663 | 1.668E−20 | 1277.8 | 92.9 | 18.6 | 161 |
| 400 | 673 | 3.281E−20 | 2513.9 | 182.7 | 36.6 | 82 |
| 410 | 683 | 6.328E−20 | 4848.7 | 352.5 | 70.6 | |
| 420 | 693 | 1.197E−19 | 9176.2 | 667.0 | 133.7 | |
| 430 | 703 | 2.226E−19 | 17053.8 | 1239.6 | 248.4 | |
| 440 | 713 | 4.065E−19 | 31147.9 | 2264.1 | 453.7 | |
| 450 | 723 | 7.301E−19 | 55949.9 | 4067.0 | 815.0 | |
| 460 | 733 | 1.291E−18 | 98907.4 | 7189.5 | 1440.8 | |
| 470 | 743 | 2.247E−18 | 172186.0 | 12516.2 | 2508.2 | |
| 480 | 753 | 3.855E−18 | 295374.1 | 21470.7 | 4302.7 | |
| 490 | 763 | 6.519E−18 | 499578.0 | 36314.2 | 7277.4 | |
| 500 | 773 | 1.088E−17 | 833545.2 | 60590.2 | 12142.3 | |
| 510 | 783 | 1.791E−17 | 1372701.6 | 99781.3 | 19996.2 | |
| 520 | 793 | 2.913E−17 | 2232334.1 | 162267.8 | 32518.5 | |

Table 1 shows a ratio of an ordering reaction rate and an ordering treatment time at the ordering reaction rate with temperature, assuming that an ordering reaction occurs as a thermally activated process with an activation energy of 60 kcal/mol. Here, the ordering treatment time shows a time to reach an 8% improvement in thermal conductivity at each ordering treatment temperature. Since the activation energy for the ordering reaction in Alloy 690 TT is reported to be 60 kcal/mol, the ratio of the ordering reaction rate and the ordering treatment time at the ordering reaction rate with temperature are calculated with the activation energy of 60 kcal/mol, as shown in Table 1.

The results of Table 1 reveal that the ordering rate during the ordering treatment is controlled by the thermally activated process, which is represented by the Arrhenius equation. In other words, the ordering rate increases exponentially with increasing temperature. Consequently, it shows that an ordering treatment at a high temperature is far more efficient in increasing the degree of order from an engineering point of view.

As shown in Table 1, a difference in the ordering rates of Alloy 690 TT at between 330° C. and 350° C. is 5 times. This implies that the ordering treatment at 350° C. for one day generates the same result as that at 330° C. for five days. Consequently, the same result can be obtained by the ordering treatment even at 350° C. or below for a too long time, which is practically hard to apply from the engineering point of view.

According to Table 1, a difference in the ordering reaction rate of Alloy 690 TT at between 350° C. and 400° C. corresponds to 36.6 times. This implies that, an 8% increase in thermal conductivity by the ordering treatment for 3,000 hours at 350° C. is obtained by the ordering treatment at 400° C. even for a much shorter time by 36.6 times, corresponding to 82 hours. In other words, when the ordering treatment temperature is increased to 400° C., the ordering treatment time can be shortened to within 100 hours to obtain the 8% increase in thermal conductivity.

As mentioned above, 3,000 hours of ordering treatment time is required at 350° C. or below due to a slow ordering reaction rate, which is too long to be applied from the engineering point of view. Specifically, considering that an 8% increase in thermal conductivity can be obtained even in the ordering treatment time within 100 hours when the ordering treatment temperature is increased to 400° C. as shown in Table 1, it is preferable that the minimum ordering treatment temperature is 400° C. from the engineering point of view.

Referring again to FIG. 4, a description on the lowest limit of the ordering treatment temperature in view of the critical significance is as follows. The results of FIG. 4 show that the thermal conductivity increase rate with increasing ordering treatment temperature sharply increases from 350° C., corresponding to a borderline. Such a sharp increase in thermal conductivity can also be seen at 420° C. As shown in FIG. 4, the thermal conductivity increase rate increases more sharply at 420° C. than at 350° C. and 420° C. is more noticeable as a borderline in view of the critical significance.

In addition, referring to FIG. 4, it shows that an increase of 8% or more in thermal conductivity can be obtained by the ordering treatment at 570° C. Nevertheless, it is preferable that the ordering treatment temperature be set to 510° C. or below. Despite the smaller increase rate of thermal conductivity by the ordering treatment at temperatures equal to or above 510° C. as compared to 475° C., the thermal conductivity increase rate by the ordering treatment at 510° C. and above reaches tens of percent, indicating a significant increase in thermal conductivity as compared to that before the ordering treatment. Nonetheless, considering an increase in disorder due to the order-disorder phase transformation, leading to a decrease in strength and resistance to PWSCC by the ordering treatment at 510° C. and higher, those ordering treatment temperatures equal to and higher than 510° C. are not preferable from the engineering point of view. In other words, it seems that upon the ordering treatment at 510° C. and higher for 3000 hours, a disordering reaction instead of the ordering reaction occurs, resulting in a thermal conductivity decrease. Consequently, to achieve an 8% or more increase in thermal conductivity, the ordering treatment temperature is preferably set as 570° C. or below, and is preferably limited to 510° C. or below.

Referring to FIG. 4, the highest limit of the ordering treatment temperature in view of the critical significance is described as follows. As shown in FIG. 4, starting from 510° C., the thermal conductivity increase rate with increasing ordering treatment temperature sharply decreases. Such a sharp decrease in the thermal conductivity increase rate can also be observed at the ordering treatment temperature of 570° C. Given the facts shown in FIG. 4 that the thermal conductivity increase rate more sharply decreases at 510° C. than at 570° C., 510° C. is more noticeable as a borderline in view of the critical significance.

In summary, from the engineering point of view, to achieve an 8% increase in thermal conductivity of ordered Alloy 690, the preferable minimum and maximum ordering temperatures are 400° C. and 510° C., respectively, according to the present invention. In addition, in view of the critical significance, the preferable minimum ordering treatment temperature for ordered Alloy 690 with the thermal conductivity increase of 8% and higher according to the present invention is 420° C., whereas the maximum ordering treatment temperature is 510° C.

Referring again to FIG. 4, the thermal conductivity of ordered Alloy 690 which is given the ordering treatment for 3,000 hours at 475° C. increases by 96% at 294° C., corresponding to an operating condition of nuclear power plants, as compared to before the ordering treatment. When the thermal conductivity increase rate of ordered Alloy 690 by the ordering treatment is determined based on the reference values listed in ASME Section II, Part D Properties, Table TDC (N06690), the thermal conductivity increase of ordered Alloy 690 corresponds to 119% at 294° C. This implies that, when the ordered Alloy 690 is used as steam generator tubes of nuclear power plants, the heat transfer from the primary coolant loop to the secondary one increases by about 119% in nuclear power plants. This is because total heat flow is directly proportional to the thermal conductivity of steam generator tubes according to a heat transfer equation. Consequently, in the steam generators made of ordered Alloy 690 with a higher thermal conductivity by around 100%, the same amount of thermal heat transferred to the secondary coolant loop can be obtained even when a number of steam generator tubes decreases by half or more, leading the size of a steam generator to be reduced by half.

Furthermore, a coolant temperature of the primary coolant loop is lowered, improving the thermal and mechanical stability of the structural materials being used in the primary systems of nuclear power plants due to a decrease in their operational temperature. Consequently, even at the same size of the steam generators, the heat quantity transferred from the primary coolant loop to the secondary one increases twice at the maximum, thus leading to an increase in a steam output.

Although the method of manufacturing ordered Alloy 690 with improved thermal conductivity according to the present invention is focused on an increase in thermal conductivity, the atomic arrangement of the ordered Alloy 690 is stabilized due to the ordering treatment, thus causing little changes in the atomic arrangement that may occur in use in nuclear power plants, and decreasing lattice contractions caused by the changes in the atomic arrangement. In other words, according to the present invention, not only is the thermal conductivity of the ordered Alloy 690 improved, but its lattice contraction also decreases in use in nuclear power plants, thus increasing its PWSCC resistance.

Figure 5:
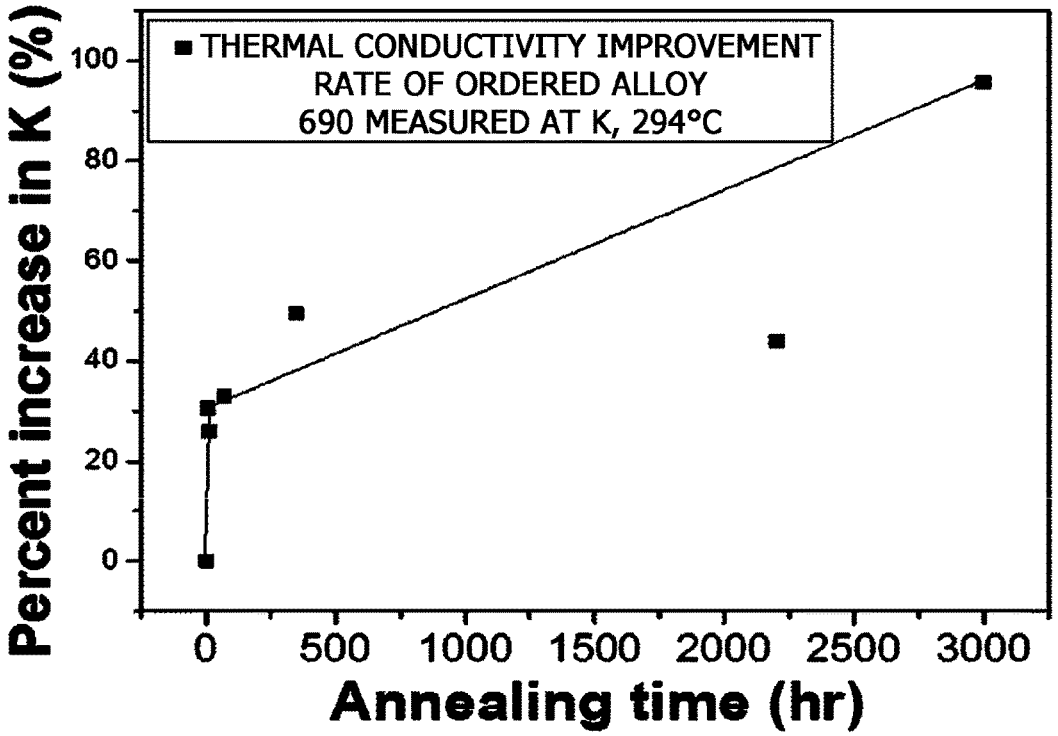
FIG. 5 is a graph illustrating a thermal conductivity increase rate of ordered Alloy 690 at 294° C. with ordering treatment time at 475° C. as compared to before the ordering treatment.

FIG. 5 is a graph illustrating the thermal conductivity increase rate of ordered Alloy 690 at 294° C. with ordering treatment time at 475° C. as compared to before the ordering treatment. In other words, FIG. 5 macroscopically shows an increasing trend of thermal conductivity of ordered Alloy 690 at 294° C. when the ordering treatment is conducted up to 3,000 hours at 475° C. As shown in FIG. 5, an ordering effect upon the ordering treatment at 475° C. rapidly increases at an early stage, and then the thermal conductivity increase rate linearly increases in accordance with time up to a 95.6% at the ordering treatment time of 3,000 hours.

Figure 6:
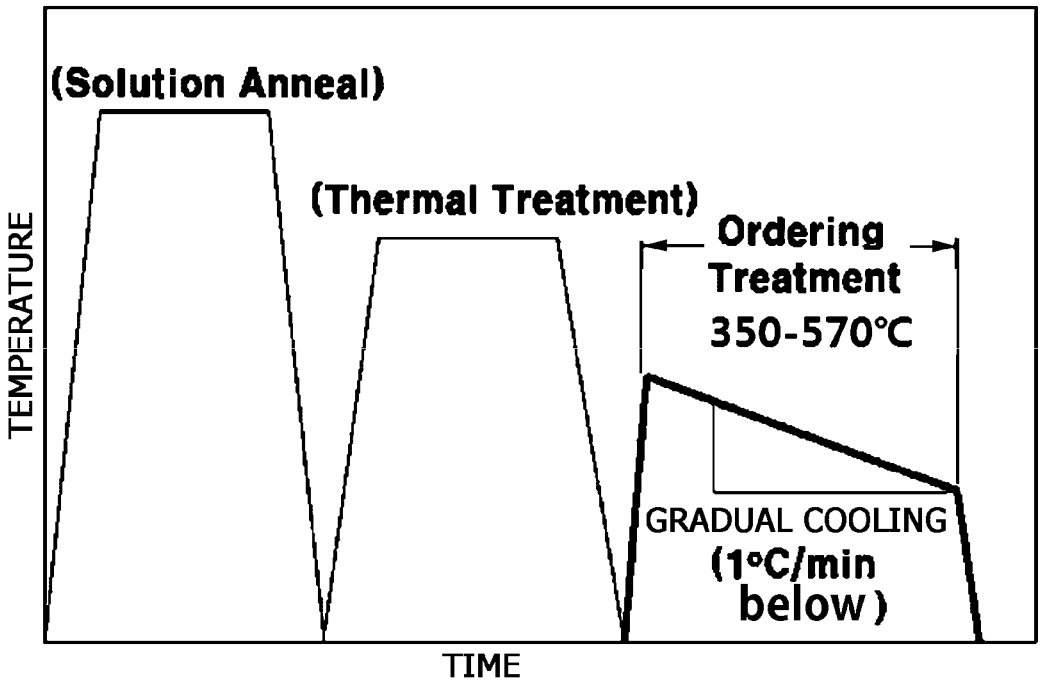
FIG. 6 is a drawing of a process of manufacturing ordered Alloy 690 with improved thermal conductivity according to a third embodiment of the present invention.

FIG. 6 is a drawing showing a manufacturing process for ordered Alloy 690 with improved thermal conductivity according to a third embodiment of the present invention. As shown in FIG. 6, Alloy 690 is solution-annealed, water quenched and thermally treated followed by cooling to make Alloy 690 TT with carbides primarily precipitated at grain boundaries. Then, Alloy 690 is given the ordering treatment additionally. Since the atomic ordering can occur in a temperature range of 350-570° C., a constant temperature needs not be maintained during the ordering treatment process, but a slow cooling rate of 1° C./min and lower should be kept from 570° C. or below as illustrated in FIG. 6 for the ordering treatment time to be at least an one hour or longer on cooling in a temperature range of 510-450° C.

Figure 7:
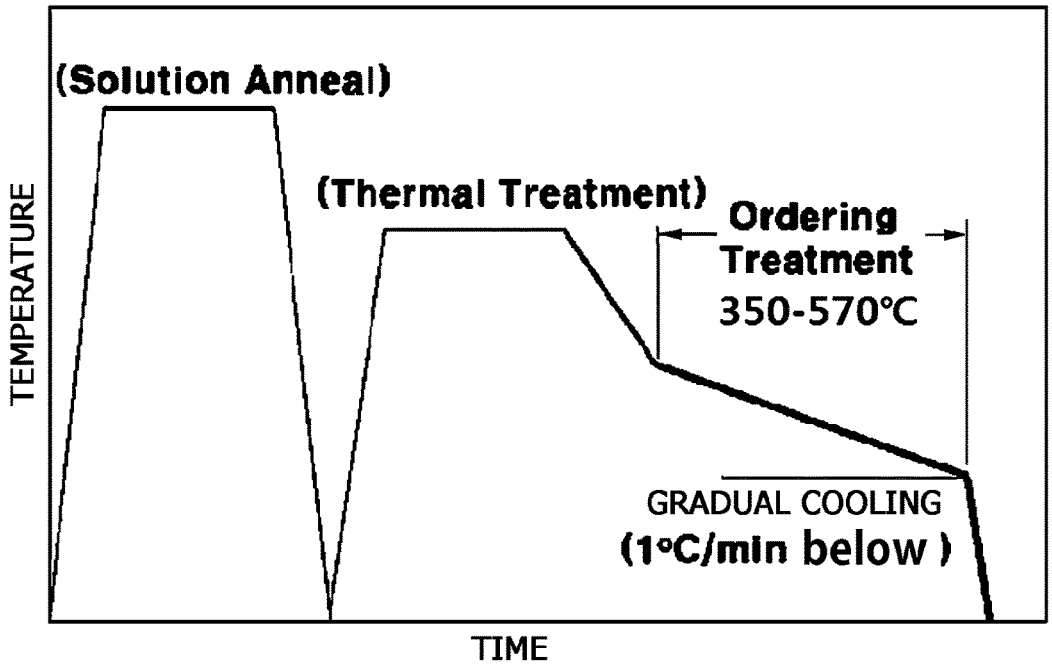
FIG. 7 is a drawing of a process of manufacturing ordered Alloy 690 with improved thermal conductivity according to a fourth embodiment of the present invention.

FIG. 7 is a drawing showing a manufacturing process for ordered Alloy 690 with improved thermal conductivity according to a fourth embodiment of the present invention. As shown in FIG. 7, Alloy 690 is solution-annealed, water quenched and thermally treated to make Alloy 690 TT with carbides primarily precipitated at grain boundaries. Then, before cooling to room temperature in the cooling process after the thermal treatment, the ordering treatment is performed. Unlike the case illustrated in FIG. 2, a constant temperature is not maintained during the ordering treatment but a slow cooling at a cooling rate of 1° C./min at 570° C. or below is possible. For example, upon cooling at 0.1° C./min in the temperature range of 350-570° C., an ordering treatment effect appears.

Figure 8:
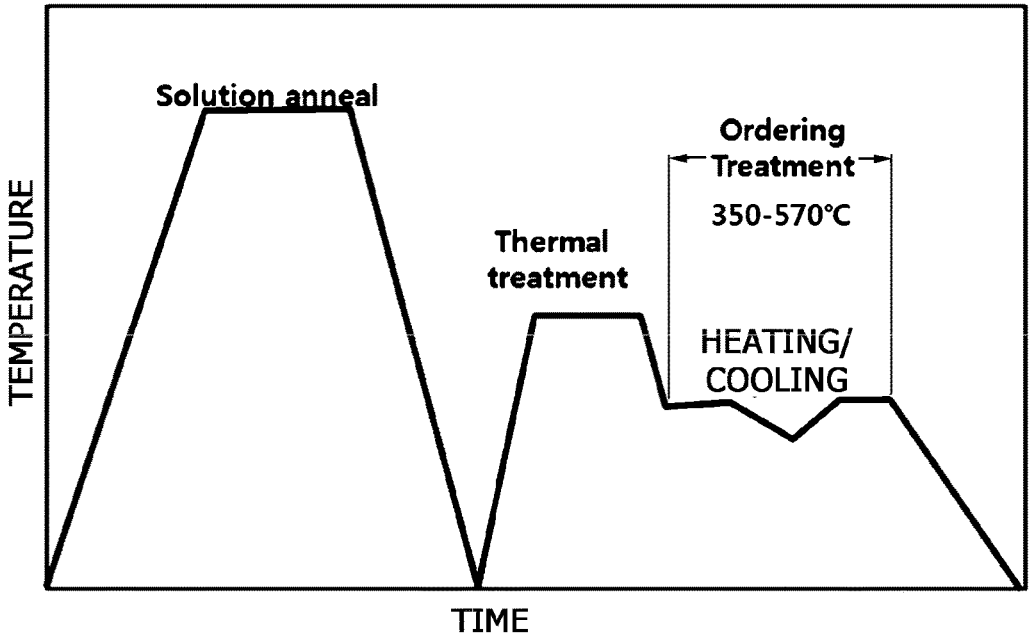
FIG. 8 is a drawing of a process of manufacturing ordered Alloy 690 with improved thermal conductivity according to a fifth embodiment of the present invention.

FIG. 8 is a drawing showing a manufacturing process for ordered Alloy 690 with improved thermal conductivity according to a fifth embodiment of the present invention. As shown in FIG. 8, Alloy 690 is solution-annealed, water quenched and thermally treated to make Alloy 690 TT with carbides primarily precipitated at grain boundaries. Then, before cooling to room temperature in the cooling process after the thermal treatment, the ordering treatment is performed. Here, as illustrated in FIG. 8, a process of cooling and heating once or more times between 350-570° C. is possible during the ordering treatment. Even in this case, the ordering treatment effect appears even if a constant temperature is not maintained in the temperature range of 350-570° C. and a process of heating and cooling is repeated once or more times. For example, the ordering treatment effect will be noticeable even when heating and cooling are repeated once or more times in the temperature range of 470-480° C.

Figure 9:
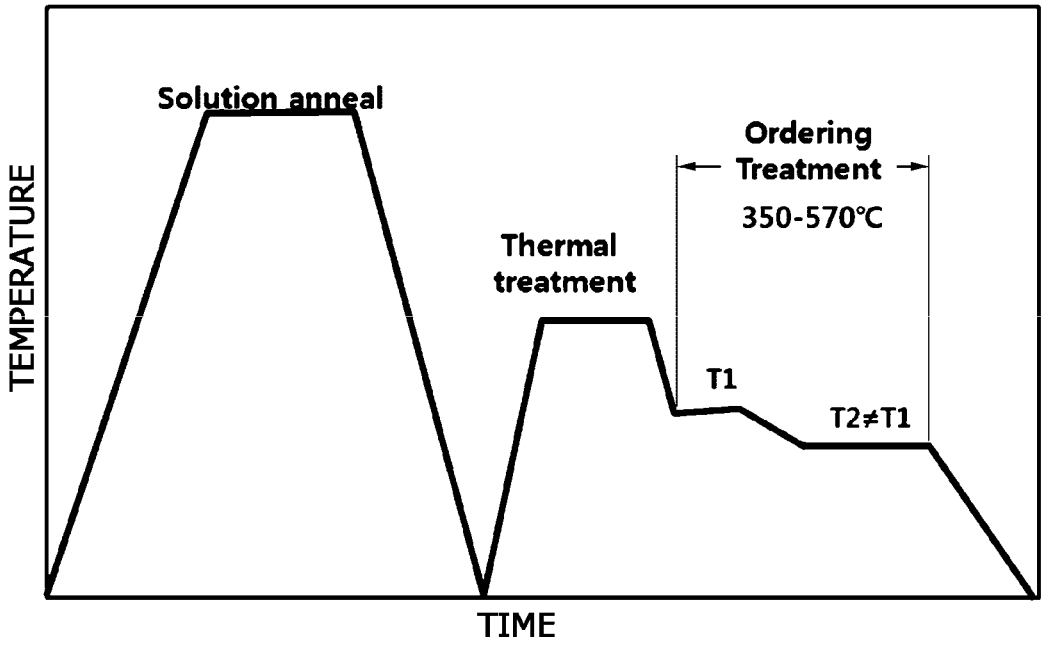
FIG. 9 is a drawing of a process of manufacturing ordered Alloy 690 with improved thermal conductivity according to a sixth embodiment of the present invention.

FIG. 9 is a drawing showing a manufacturing process for ordered Alloy 690 with improved thermal conductivity according to a sixth embodiment of the present invention. As shown in FIG. 9, Alloy 690 is solution-annealed, water quenched and thermally treated to make Alloy 690 TT with carbides primarily precipitated at grain boundaries. Then, before cooling to room temperature in the cooling process after the thermal treatment, the ordering treatment is performed. Here, as illustrated in FIG. 9, a multi-stage ordering treatment where the ordering treatment is consecutively conducted at two or more different temperatures in the range of 350-570° C. is possible. For example, the ordering treatment may be maintained at 490° C. for a predetermined amount of time, and consecutively maintained at 450° C. for a predetermined amount of time. In this case, the ordering treatment temperatures in the multi-stage process do not always have to decrease from a higher temperature to a lower temperature. The first step may be performed at 450° C., and the second step may be performed at 490° C.

Figure 10:
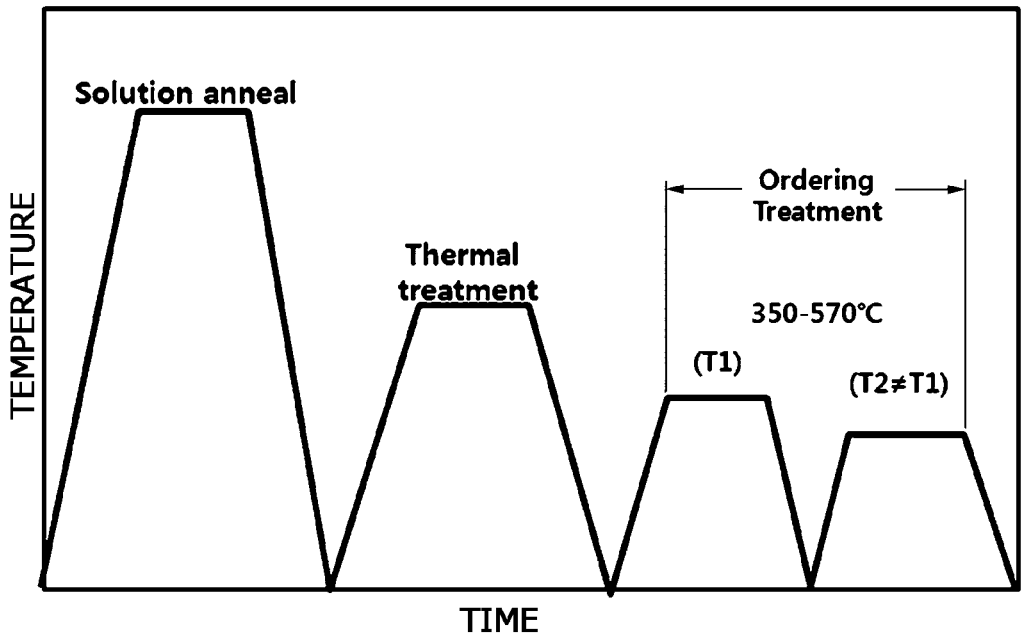
FIG. 10 is a drawing of a process of manufacturing ordered Alloy 690 with improved thermal conductivity according to a seventh embodiment of the present invention.

FIG. 10 is a drawing showing a manufacturing process for ordered Alloy 690 with improved thermal conductivity according to a seventh embodiment of the present invention. As shown in FIG. 10, Alloy 690 is solution-annealed, water quenched and thermally treated to make Alloy 690 TT with carbides primarily precipitated at grain boundaries. Then, after cooling to room temperature, the ordering treatment is performed. Here, as illustrated in FIG. 10, the ordering treatment is a process which includes cooling and heating such that the ordering treatment is performed at two or more different temperatures in the range of 350-570° C. Heating, cooling and heating for the ordering treatment in the temperature range in which the ordering treatment effect is working is also possible.

The embodiments described above are merely a few embodiments for implementing ordered Alloy 690 with improved thermal conductivity according to the present invention, and the present invention is not limited to the above-mentioned embodiments. As claimed in the patent claims below, it should be understood that the technical spirit of the present invention includes the scope in which those of ordinary skill in the art to which the present invention pertains would be able to modify the embodiments in various ways without departing from the gist of the present invention.

The invention claimed is:

1. A method of manufacturing a Ni-based alloy, the method comprising:

solution-annealing Alloy 690;

performing a first thermal treatment for the solution-annealed Alloy 690 at a temperature within a first range of 700-750° C. for a period of 15-24 hours to provide a first-treated Alloy 690; and subsequently performing a second thermal treatment for the first-treated Alloy 690 at a temperature within a second range of 350-570° C., which provides a second-treated Alloy 690 that has a thermal conductivity rate higher than that of the first-treated Alloy 690 by at least 8%.

2. The method of claim 1, wherein the second thermal treatment follows the first thermal treatment without cooling the first-treated Alloy 690 resulting from the first thermal treatment to room temperature.

3. A method of manufacturing a Ni-based alloy, the method comprising:

providing Alloy 690;

performing a first thermal treatment for the Alloy 690 at a temperature within a first range of 700-750° for a period of 15-24 hours to provide a first-treated Alloy 690; and subsequently performing a second thermal treatment for the first-treated Alloy 690 at a temperature within a second range of 350-570° C., which provides a second-treated Alloy 690 that has a thermal conductivity rate higher than that of the first-treated Alloy 690 by at least 8%.

4. The method according to claim 1, wherein the second range is 400-510° C.

5. The method according to claim 3, wherein the second range is 400-510° C.

6. The method according to claim 1, wherein the second thermal treatment comprises reducing the temperature within the second range at a rate of 1° C./min or lower.

7. The method according to claim 4, wherein the second thermal treatment comprises reducing the temperature within the second range at a rate of 1° C./min and lower.

8. The method according to claim 1, wherein the second thermal treatment comprises a process of cooling and heating within the second range at least once.

9. The method according to claim 4, wherein the second thermal treatment comprises a process of cooling and heating within the second range at least once.

10. The method according to claim 1, wherein the second thermal treatment is performed at two or more different temperatures within the second range.

11. The method according to claim 4, wherein the second thermal treatment is performed at two or more different temperatures within the second range.

12. The method according to claim 1, wherein a process of cooling and heating is performed at least once at two or more different temperatures within the second range.

13. The method according to claim 4, wherein cooling and heating processes are performed at least once at two or more different temperatures within the second range.

* * * * *